United States Patent [19]

Simmons

[11] Patent Number: 4,648,387

[45] Date of Patent: Mar. 10, 1987

[54] MASSAGE IMPLEMENT

[76] Inventor: Lois M. Simmons, 8904 Nelson Way, Escondido, Calif. 92026

[21] Appl. No.: 740,582

[22] Filed: Jun. 3, 1985

[51] Int. Cl.[4] ..... A61H 15/00; A63B 23/04

[52] U.S. Cl. ..... 128/57; 128/25 B; 128/67; 272/96

[58] Field of Search ..... 128/24.2, 24 R, 24 A, 128/25 B, 28, 32–40, 45, 46, 47, 50–53, 56, 57, 59, 61, 62, 65, 66, 67; 272/96; 15/28, 29

[56] References Cited

U.S. PATENT DOCUMENTS

| | | | |
|---|---|---|---|
| 1,111,427 | 9/1914 | Archibald | 128/57 |
| 2,307,554 | 1/1943 | Wettlaufer | 128/36 |
| 3,096,757 | 7/1963 | Berard | 128/36 |
| 3,548,814 | 12/1970 | Montgomery | 128/57 |
| 3,750,654 | 8/1973 | Shiu | 128/57 |
| 3,994,289 | 11/1976 | Thomas | 128/57 |
| 4,345,757 | 8/1982 | Voi | 128/57 |

FOREIGN PATENT DOCUMENTS

| | | | |
|---|---|---|---|
| 1132418 | 9/1982 | Canada | 128/25 B |
| 252397 | 3/1927 | Italy | 272/57 |
| 480805 | 5/1953 | Italy | 128/57 |
| 11541 | of 1903 | United Kingdom | 128/57 |
| 2091108 | 7/1982 | United Kingdom | 128/57 |

*Primary Examiner*—Clyde I. Coughenour
*Attorney, Agent, or Firm*—Baker, Maxham & Jester

[57] ABSTRACT

A massage implement comprises a plurality of rollers mounted on an elongated cylindrical shaft with an elongated handle on each end of the shaft extending axially thereof with the rollers having a plurality of pressure pads disposed in annular rows around the respective rollers. An alternate embodiment includes a single roller mounted for rotation on a shaft extending axially of a single handle with the handle including a rounded end that also serves as a pressure surface for applying a massaging pressure to a selected area of the body.

5 Claims, 5 Drawing Figures

MASSAGE IMPLEMENT

BACKGROUND OF THE INVENTION

The present invention relates generally to the art of massaging and pertains particularly to improved implements and methods of massaging.

The massaging of various parts of the body is an old and well known art. It is well known that massaging relaxes the muscles, improves circulation, and generally improves the feeling of well being of an individual. It is also believed that massaging has major health benefits.

Perhaps the oldest and most well known technique of massaging is by the use of the hands and fingers of the masseuse. However, certain massaging implements have been developed over the years, and some are believed to provide almost equal benefits.

While finger massaging is believed to be most beneficial, the hand or finger massage is exhausting for the masseuse and cannot be self applied. For this reason, certain implements have been developed in an effort to provide somewhat equivalent benefit to hand or finger massage and also to enable self massaging.

It is therefore desirable that suitable implements and methods be available for obtaining substantially the equivalent benefit of hand or finger massage and also for self application.

SUMMARY AND OBJECTS OF THE INVENTION

It is therefore the primary object of the present invention to provide a improved implements and methods for massaging.

In accordance with the primary aspect of the present invention, an improved massager comprises a plurality of rollers mounted for rotation about a shaft mounted between a pair of axially extending handles. The rollers include a plurality of radially extending pressure pads for applying pressure to specific areas of the body. An alternate embodiment of the invention includes a single roller on a single handle with the handle also serving as a pressure applicator.

BRIEF DESCRIPTION OF THE DRAWINGS

The above and other objects and advantages of the present invention will become apparent from the following description when read in conjunction with the drawings wherein.

DETAILED DESCRIPTION OF PREFERRED EMBODIMENTS

Figure 1:
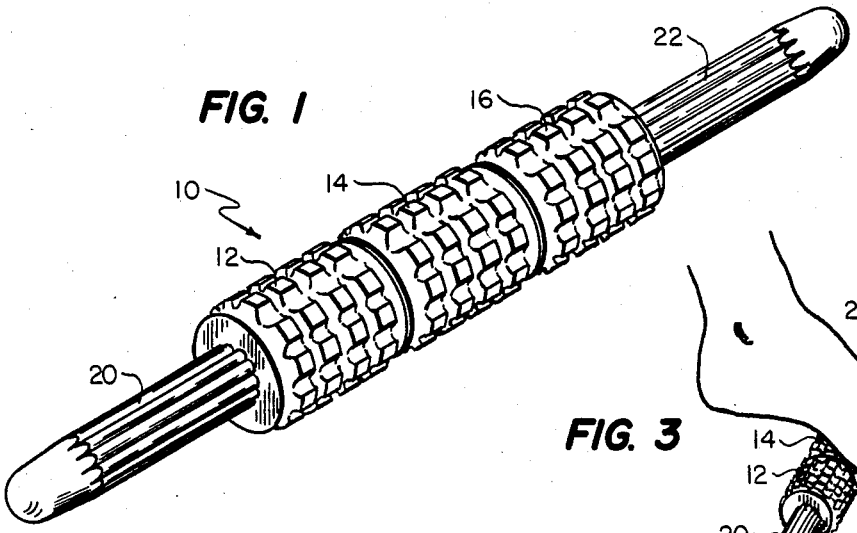
FIG. 1 is a perspective view of a preferred embodiment of the invention.

Referring to FIG. 1 of the drawing, a massaging implement designated generally by the numeral 10 comprises a roller assembly comprising three separate individual identical rollers 12, 14 and 16 mounted for rotation on a shaft 18 which is supported between a pair of handles 20 and 22 which are co-axial of the shaft and each other. The rollers 12, 14 and 16 are preferably each identical and constructed of a suitable wood, which is preferably a hardwood and mounted on a wooden shaft similarly with wooden handles.

Since the rollers are identical, only a single roller will be described in detail. Referring specifically to roller 12, the roller is constructed to have a plurality of radially projecting pressure pads 24,26 and 27 and 28 disposed in the illustrated embodiment in four circular rows spaced apart along the roller. The roller is preferably constructed of a hardwood, such as selected from the group comprising oak, birch, and any other suitable hard woods. The pads are constructed to have a pitch on the order of about one-half inch with the pads each having a surface area of a generally rectangular configuration on the order of about a quarter of an inch wide and a half inch long. The rollers are constructed to be about two inches in length and about one and five-eighths inches in diameter with each of the rows of pads having about ten pads per roll. This forms a roller of the preferred size which can be combined with two other rollers in the arrangement as shown in FIG. 1. The three rollers are mounted to be rotatable independently of one another.

The rollers are rotatably mounted on a shaft 18 which is mounted between the handles 20 and 22 which extend into pilot bores 30 and 32 in the ends of the respective handles 20 and 22. The ends of the shaft are secured in the bores by suitable means such as a glue or other bonding agent.

The handles 20 and 22 are preferably constructed to be elongated and fluted with a plurality of grooves and ridges extending along the length thereof on the outer surface defining a plurality of flutes extending therealong. Each handle 20 and 22 respectively have a plurality of the ridges or flutes 34 and 36 respectively extending therealong. This improves the grip for gripping and using the handle. The handle further includes an outer semi-spherical tip 38 and 40, each of which define a further pressure surface or pad for application of pressure to selected areas of the body or anatomy for the massaging function.

In operation, the roller is rolled over selected areas of the body with the pressure pads applying specific pressure to the limited area of its engagement as the roller passes along the selected area of the body. The pressure is found to stimulate blood circulation, causing blood to flow to the surface of the skin, thereby improving circulation.

The rollers are also useful in the science known as Reflexology. The theory of Reflexology is that every organ and part of the body has a reflex on the bottom of the feet and the palms of the hands. Congestion in an area of the body manifests itself as crystals or fibers at the corresponding pressure points on the foot or hand. These are located and massaged to help massage away the congestion which helps the body heal itself. The implements of the present invention, along with the methods herein, were conceived and developed to help accomplish this purpose.

Figure 3:
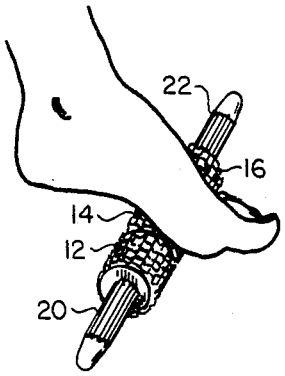
FIG. 3 is a perspective view showing the embodiment in FIG. 1 in use.
Figure 2:
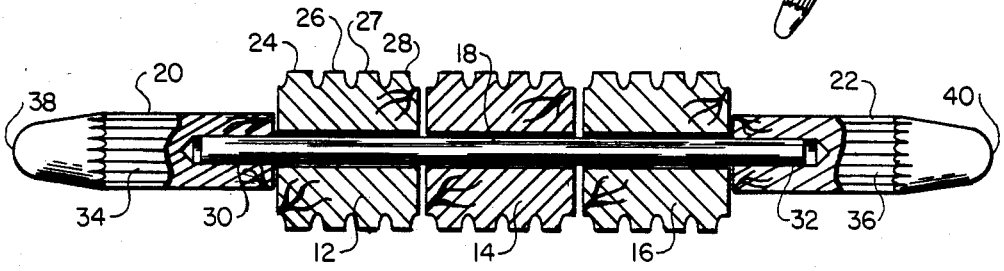
FIG. 2 is a side elevation view, partially in section, showing details of construction of the embodiment of FIG. 1.

Referring to FIG. 3 by way of example, one technique of massaging the bottom of the foot is the placement of the roller on a surface such as on the floor and rolling it along with the bottom of the foot, thereby rolling the roller along the bottom surface of the foot. This massages the bottom of the foot with each pressure pad covering a separate area during each pass of the roller.

Figure 4:
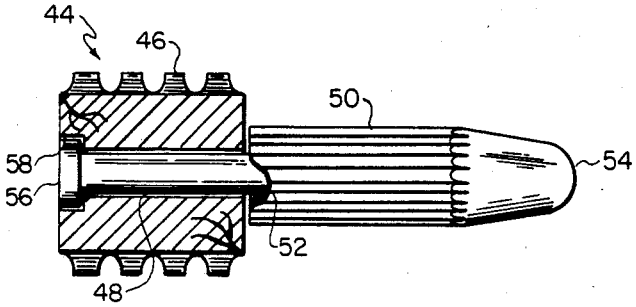
FIG. 4 is a side elevation view partially in section of an alternate embodiment.

Referring to FIG. 4 of the drawing, an alternate embodiment is illustrated. This embodiment designated generally by the numeral 44 is constructed substantially the same as the rollers 12, 14 and 16, but is mounted as a single roller 46 on a shaft 48 which is mounted on one end of a handle 50, extending for example in a pilot bore 52. The handle 50 is constructed identical to those of 20 and 22 with flutes extending along the surface and an outer tip 54 shaped as in the previous embodiment to serve as a pressure applicator.

The outer end of the shaft 48 includes an enlarged button member 56 which is recessed into a counter bore 58 in the end of the roller 46 to thereby extend flush with the outer end thereof.

Figure 5:
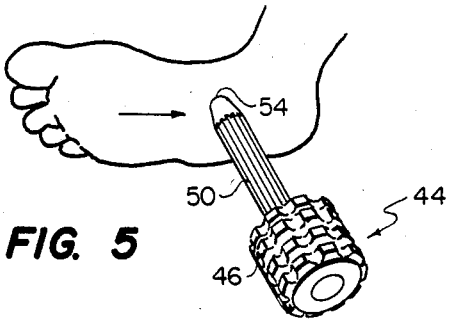
FIG. 5 is a perspective view showing the embodiment of FIG. 4 in use.

The roller or roller assembly 44 can be applied in the same manner as the previous embodiment. The roller assembly is shown in FIG. 5 with the use of the pressure surface 54 being applied to an area on the bottom of the foot. Minor modifications can be made in the illustrated structures without departing from the spirit and scope of the invention.

The method of the invention includes the steps of selecting the appropriate one of a roller constructed as illustrated and previously described and applying it in a suitable manner to massage a selected area of the body. This includes the steps of applying either the roller or the pressure surface at the end of the handle to a selected area of the body or anatomy. The selection of a roller with the multiple roller embodiment or the single roller embodiment may be governed by considerations such as whether applying to the hands or feet or to other areas of the body. While other massaging rollers of various configurations and constructions are known, they are not believed to provide the superior benefits of the present invention. Such rollers do not provide or teach the importance of the separate pressure areas as discovered by me and as taught herein.

While I have illustrated and described my invention by means of specific embodiments, it is to be understood that numerous changes and modifications may be made therein without departing from the spirit and scope of the invention as defined in the appended claims.

I claim:

1. A massage implement comprising:

a first and a second elongated generally cylindrical handle, each having a proximal end and a distal end;

said distal end having a semi-spherical tip to provide a pressure surface for application of massaging pressure to selected areas of the body;

each of said handles including a portion of uniform diameter between said proximal end and said tip, the outer surface of said handle portion having a plurality of circumferentially spaced, longitudinally extending flutes to provide a gripping surface on said handle both during the rolling application of said rollers to the body and during said application of massaging pressure to selected areas of the body with said tip;

an elongated cylindrical shaft having a first end and a second end and secured at said first end co-axially to said proximal end of said first handle and extending co-axially therefrom and connected at said second end to said proximal end of said second handle; and a plurality of generally cylindrical rollers rotatably mounted on said shaft, each said rollers having a plurality of first grooves extending along the surface of said roller parallel to the axis thereof, and a plurality of second grooves extending around the circumference of said roller for defining a plurality of pressure pads, each having a generally rectangular pressure surface extending radially outward from the outer surface of said roller and disposed in a plurality of circumferential rows around said roller.

2. A massage implement according to claim 1 wherein said pressure pads have an area of about one-quarter inch by about one-half inch.

3. A massage implement according to claim 2 wherein said rollers are constructed from a hardwood taken from the group consisting of oak and birch.

4. A massage implement according to claim 3 wherein said rollers have a diameter of about one and five-eighths and a length of about two inches.

5. A massage implement according to claim 4 wherein said pressure pads are disposed in four rows of about ten pads per row on each roller.

* * * * *